US008459762B2

(12) United States Patent
Yui et al.

(10) Patent No.: US 8,459,762 B2
(45) Date of Patent: Jun. 11, 2013

(54) RECORDING APPARATUS AND RECORDING METHOD

(75) Inventors: Toshitake Yui, Kanagawa (JP); Yoshiro Yamashita, Kanagawa (JP); Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 506 days.

(21) Appl. No.: 12/362,749

(22) Filed: Jan. 30, 2009

(65) Prior Publication Data

US 2010/0073410 A1 Mar. 25, 2010

(30) Foreign Application Priority Data

Sep. 24, 2008 (JP) ..... 2008-244824

(51) Int. Cl.

| | |
|---|---|
| ***B41J 29/38*** | (2006.01) |
| *B41J 2/015* | (2006.01) |
| *B41J 2/165* | (2006.01) |
| *B41J 2/17* | (2006.01) |
| *B41J 2/175* | (2006.01) |
| *B41J 2/01* | (2006.01) |

(52) U.S. Cl.
USPC ..... 347/6; 347/5; 347/21; 347/23; 347/84; 347/85; 347/101; 347/102

(58) Field of Classification Search
USPC ..... 347/102, 5, 6, 21, 84, 85, 101
See application file for complete search history.

(56) References Cited

U.S. PATENT DOCUMENTS

| | | | | |
|---|---|---|---|---|
| 6,481,840 | B1 * | 11/2002 | Mueller et al. | 347/88 |
| 6,720,042 | B2 * | 4/2004 | Ylitalo et al. | 428/32.26 |
| 6,945,631 | B2 * | 9/2005 | Adachi | 347/55 |
| 7,033,013 | B2 * | 4/2006 | Koyano et al. | 347/100 |
| 7,066,567 | B2 * | 6/2006 | Nishino | 347/17 |
| 7,370,948 | B2 * | 5/2008 | Inoue | 347/84 |
| 7,556,368 | B2 * | 7/2009 | Gervasi et al. | 347/103 |
| 7,770,990 | B2 * | 8/2010 | Nagashima | 347/10 |
| 7,789,502 | B2 * | 9/2010 | Domoto et al. | 347/102 |
| 7,815,303 | B2 * | 10/2010 | Kasai | 347/102 |
| 7,878,642 | B2 * | 2/2011 | Takabayashi | 347/100 |
| 7,946,699 | B2 * | 5/2011 | Nakazawa et al. | 347/102 |
| 7,971,981 | B2 * | 7/2011 | Nagashima et al. | 347/89 |

(Continued)

FOREIGN PATENT DOCUMENTS

| | | |
|---|---|---|
| JP | 07-241983 | 9/1995 |
| JP | 2000-94654 | 4/2000 |
| JP | 2000-343808 | 12/2000 |
| JP | 2002-229217 | 8/2002 |
| JP | 2002-321443 | 11/2002 |

(Continued)

*Primary Examiner* — Laura Martin
*Assistant Examiner* — Jeremy Bishop
(74) *Attorney, Agent, or Firm* — Fildes & Outland, P.C.

(57) ABSTRACT

A recording apparatus includes: an intermediate transfer member; a supply unit that supplies a curable liquid onto the intermediate transfer member, the curable liquid including at least one curable material that is cured by an external stimulus and a liquid absorbing material; a first temperature information acquisition unit that acquires temperature information related to the curable liquid; a temperature regulation unit that regulates the temperature of the curable liquid supplied onto the intermediate transfer member; an ink application unit that applies ink onto a curable liquid layer formed on the intermediate transfer member; a transfer unit that brings the curable liquid layer onto which the ink has been applied into contact with a recording medium, and transfers the curable liquid layer from the intermediate transfer member to the recording medium; and a stimulus application unit that applies a stimulus for curing the curable liquid layer to the curable liquid layer.

13 Claims, 6 Drawing Sheets

U.S. PATENT DOCUMENTS

| | | | | |
|---|---|---|---|---|
| 7,992,990 | B2 * | 8/2011 | Yamashita et al. | 347/102 |
| 8,109,597 | B2 * | 2/2012 | Hori | 347/23 |
| 2003/0068571 | A1 | 4/2003 | Uehara et al. | |
| 2005/0173680 | A1 | 8/2005 | Yang | |
| 2005/0176849 | A1 | 8/2005 | Yang | |
| 2006/0284951 | A1 * | 12/2006 | Ikeda et al. | 347/103 |
| 2007/0046720 | A1 * | 3/2007 | Konno et al. | 347/21 |
| 2007/0176995 | A1 * | 8/2007 | Kadomatsu et al. | 347/103 |
| 2008/0062241 | A1 | 3/2008 | Yamashita et al. | |

FOREIGN PATENT DOCUMENTS

| | | |
|---|---|---|
| JP | 2002-370347 | 12/2002 |
| JP | 2003-57967 | 2/2003 |
| JP | 2005-223323 | 8/2005 |
| JP | 2005-229109 | 8/2005 |
| JP | 2007-230232 | 9/2007 |
| JP | 2008-068429 | 3/2008 |
| JP | 2008-080655 | 4/2008 |

* cited by examiner

RECORDING APPARATUS AND RECORDING METHOD

CROSS-REFERENCE TO RELATED APPLICATIONS

This application is based on and claims priority under 35 USC 119 from Japanese Patent Application No. 2008-244824 filed Sep. 24, 2008.

BACKGROUND

1. Technical Field

The present invention relates to a recording apparatus and a recording method.

2. Related Art

As a recording method using ink, a method that includes transferring to a recording medium after recording on an intermediate member has been proposed in order to perform recording on various kinds of recording media.

SUMMARY

According to an aspect of the invention, there is provided a recording apparatus comprising:

an intermediate transfer member;

a supply unit that supplies a curable liquid onto the intermediate transfer member, the curable liquid including at least one curable material that is cured by an external stimulus and a liquid absorbing material;

a first temperature information acquisition unit that acquires temperature information related to the curable liquid;

a temperature regulation unit that regulates the temperature of the curable liquid supplied onto the intermediate transfer member;

an ink application unit that applies an ink onto a curable liquid layer formed on the intermediate transfer member;

a transfer unit that brings the curable liquid layer onto which the ink has been applied into contact with a recording medium, and transfers the curable liquid layer from the intermediate transfer member to the recording medium; and a stimulus application unit that applies a stimulus for curing the curable liquid layer to the curable liquid layer.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the present invention will be explained with reference to accompanied drawings. Note that, the members having substantially the same functions are provided with the same reference marks throughout the whole drawings, and repeated explanations will be omitted in some cases.

Figure 1:
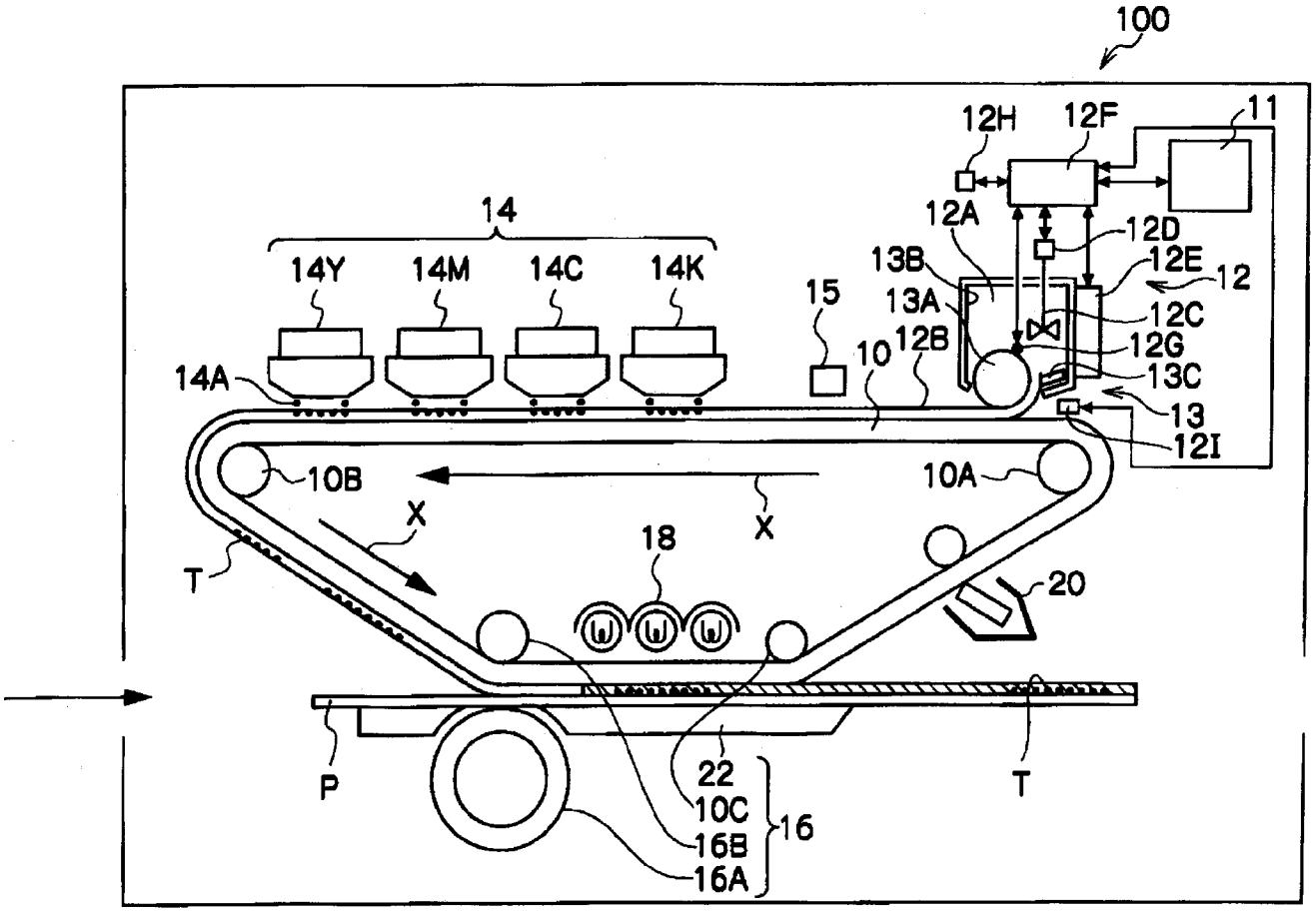
FIG. 1 is a block diagram showing a recording apparatus according to an exemplary embodiment of the present invention.

As shown in FIG. 1, a recording apparatus 100 according to the present exemplary embodiment is equipped with an intermediate transfer belt 10 (intermediate transfer member) in the form of an endless belt. Around this intermediate transfer belt 10, from the upstream side along the traveling direction of the intermediate transfer belt 10 (in FIG. 1, in the direction designated by an arrow X), a temperature regulation unit 12, a supply unit 13, a cooling unit 15, a recording head 14, a transfer unit 16, and a cleaning unit 20 are disposed in this order.

Here, the recording apparatus 100 corresponds to the recording apparatus according to the exemplary embodiment of the present invention, and the intermediate transfer belt 10 corresponds to the intermediate transfer member of the recording apparatus according to the exemplary embodiment of the present invention. Further, the supply unit 13 corresponds to a supply unit of the recording apparatus according to the exemplary embodiment of the present invention, and the temperature regulation unit 12 corresponds to the temperature regulation unit of the recording apparatus according to the exemplary embodiment of the present invention. Still further, the recording head 14 corresponds to an ink application unit of the recording apparatus according to the exemplary embodiment of the present invention, the transfer unit 16 corresponds to the transfer unit, and a stimulus application device 18 corresponds to the stimulus application unit.

The supply unit 13 supplies a curable liquid 12A onto the intermediate transfer belt 10 to form a curable liquid layer 12B on the intermediate transfer belt 10. The curable liquid 12A, the details thereof will be described later, includes a curable material that is cured by an external stimulus and a liquid absorbing material that exhibits a liquid absorbing property to an ink ejected from the recording head 14.

The recording head 14 applies ink drops 14A onto the curable liquid layer 12B formed on the intermediate transfer belt 10 so as to form an image T on the curable liquid layer 12B. The transfer unit 16 brings the curable liquid layer 12B having the image T formed thereon into contact with a recording medium P and applies a pressure so as to transfer the curable liquid layer 12B onto the recording medium P. A cleaning unit 20 removes remained fragments of the curable liquid layer 12B, extraneous adhered material (such as paper dust of the recording medium P) or the like from the surface of the intermediate transfer belt 10.

The supply unit 13 is equipped with a temperature regulation unit 12, the details thereof will be described later, which controls the temperature of the curable liquid 12A stored in the supply unit 13.

Inside of the intermediate transfer belt 10, a stimulus application device 18 is equipped which applies a stimulus to the curable liquid layer 12B for curing the curable liquid layer 12B when the curable liquid layer 12B and the recording medium P contact each other. That is, the stimulus application device 18 is placed in a manner that it faces, through the intermediate transfer belt 10, to the area where the curable liquid layer 12B and the recording medium P are contacted.

The curable liquid 12A and the curable liquid layer 12B formed from the curable liquid 12A, the details thereof will be described later, are cured by application of heat, UV-light, or the like as an stimulus. Due to this, the stimulus application device 18 is configured so as to apply a stimulus in accordance with the kind of the curable material that is contained in the curable liquid 12A forming the curable liquid layer 12B (that is, in accordance with the stimulus for curing the curable material). For example, when the curable material contained in the curable liquid 12A is a material that is cured with UV-light, the stimulus application device 18 may be a UV irradiation device that irradiates the rays of UV-light. In the case of a material curable by heat, it may be a heat irradiation device that applies heat.

The intermediate transfer belt 10 is supported so as to be rotatable with a tension from the inner circumferential face side thereof, which is applied by three support rolls 10A, 10B, and 10C and a press roll 16B. The intermediate transfer belt 10 has a width (a length in an axial direction) substantially similar to or more than the width of the recording medium P.

Examples of the material of the intermediate transfer belt 10 may include: various kinds of resins (for example, polyimide, polyamideimide, polyester, polyurethane, polyamide, polyether sulfone, fluoro resin, or the like); various kinds of rubbers (for example, nitrile rubber, ethylene propylene rubber, chloroprene rubber, isoprene rubber, styrene rubber, butadiene rubber, butyl rubber, chlorosulfonated polyethylene, urethane rubber, epichlorohydrin rubber, acryl rubber, silicone rubber, fluoro rubber, or the like); metal materials such as stainless steel. The intermediate transfer belt 10 may be a single layer structure or a multilayer structure.

As described above, in the present exemplary embodiment, the stimulus application device 18 is positioned inside of the intermediate transfer belt 10, so that a stimulus is supplied to the curable liquid layer 12B after the stimulus passes through the intermediate transfer belt 10. Therefore, the intermediate transfer belt 10 is made of a stimulus transmissible material in order that a stimulus is supplied efficiently to the curable liquid layer 12B. In addition, the intermediated transfer belt 10 is made of a material having a high resistance against the stimulus.

For example, when the stimulus application device 18 is a UV-light irradiation device, examples of the material for forming the intermediate transfer belt 10 may include: ETFE (ethylene-tetrafluoroethylene copolymer) that is a fluoro resin; and polymethyl pentene that is a polyolefin resin.

When the stimulus application device 18 is a heat irradiation device, examples of the material for forming the intermediate transfer belt 10 may include: a resin material that is given by adding a heat conductive filler to polyamide, polyimide, polyamide imide, polyphenylene sulfide, tetrafluoroethylene perfluoroalkoxy resin, or the like; a material that is given by adding a heat conductive filler to silicone rubber, fluoro rubber, or the like; and a metallic material such as stainless steel.

Further, a surface releasing layer may be formed on the surface of the intermediate transfer belt 10 that contacts the curable liquid layer 12B.

Examples of the material used for the surface releasing layer may include a fluoro resin material, and examples thereof may include: a powder paint or a resin tube of fluoro resin, fluorine-modified urethane and silicone resins, copolymerized fluoro rubber, fluoro resin copolymerized vinylether, PFA (tetrafluoroethylene perfluoroalkoxy resin), FEP (tetrafluoroethylene-hexafluoropropylene copolymer paint) or the like; and a resin material such as a PTFE (tetrafluoroethylene) paint, a PTFE dispersed urethane paint, an ETFE (ethylene-tetrafluoroethylene copolymer) tube, PVdF (polyvinylidene fluoride), or PHV (polytetrafluorovinylidene).

In order to reduce the value of the surface free energy ($\gamma_T$) of the intermediate transfer belt 10, a releasing agent application device, which applies a releasing agent such as a silicone oil, a fluorine oil, or polyalkyleneglycol on the side of the intermediate transfer belt 10 on which the curable liquid layer 12B is formed before the curable liquid layer 12B is formed, may be equipped on the upstream side of the supply unit 13 along the direction of moving the intermediate transfer belt 10. The releasing agent application device is not particularly limited, but a device that uses known coating processes (for example, a bar coater coating, a spray coating, an ink-jet coating, an air-knife coating, a blade coating, a roll coating, or the like) may be applied.

The supply unit 13 includes a box 13B accommodating the curable liquid 12A, a supply roller 13A supplying the curable liquid 12A stored in the box 13B to the intermediate transfer belt 10, and a blade 13C regulating the thickness of the curable liquid layer 12B formed from the supplied curable liquid 12A.

The supply unit 13 may be configured in a manner that the supply roller 13A continuously contacts the intermediate transfer belt 10 or is separated from the intermediate transfer belt 10. Further, the supply unit 13 may be configured in a manner that the curable liquid 12A is supplied to the box 13B from an independent liquid supply system (not shown in the figure) so as not to interrupt the supply of the curable liquid 12A. The details of the curable liquid 12A will be described later.

The supply unit 13 is not limited to the above configurations, but may employ a device that uses known supply process (coating processes: for example, a bar coater coating, a spray coating, an ink-jet coating, an air-knife coating, a blade coating, a roll coating, or the like).

The recording apparatus 100 according to the present exemplary embodiment is further equipped with a temperature regulation unit 12. The temperature regulation unit 12 is composed of elements including a temperature sensor 12G, a stirring unit 12C, a driving unit 12D, a heating and cooling device 12E, a memory 12H, a temperature sensor 12I, and a temperature regulation control unit 12F. These temperature sensor 12G, driving unit 12D, memory 12H, temperature sensor 12I, and heating and cooling device 12E are connected to the temperature regulation control unit 12F in a manner that signals are allowed to be received or sent.

Note that, the heating and cooling device 12E corresponds to the heating and cooling unit of the recording apparatus of the present invention, the memory 12H corresponds to the information storage unit, and the temperature regulation control unit 12F corresponds to the control unit. Further, the stirring unit 12C corresponds to the stirring unit, the temperature sensor 12G corresponds to the first temperature information acquisition unit, and the temperature sensor 12I corresponds to the second temperature information acquisition unit. Specific examples of the information storage unit (memory 12H) include a hard disk.

The temperature regulation unit 12 controls the temperature of the curable liquid 12A stored in the box 13B of the supply unit 13. The temperature sensor 12G measures the temperature of the curable liquid 12A stored in the box 13B. Note that, the temperature sensor 12G may be placed at a position allowing it to measure the temperature of the curable liquid 12A store in the box 13B, and in more detail, may be placed at a position allowing it to measure the temperature of the curable liquid 12A at the time when the curable liquid 12A is supplied to the intermediate transfer belt 10 with a supply roller 13A. The stirring unit 12C stirs the curable liquid 12A in the box 13B, that is, it stirs the curable liquid 12A in the box 13B with the help of a driving force of the driving unit 12D. The heating and cooling device 12E heats or cools the curable liquid 12A stored in the box 13B. In the present exemplary embodiment, the heating and cooling device 12E is described so as to be placed in a manner that it contacts the outside of the box 13B, but the device may be placed at a position that allows the device to heat or cool the curable liquid 12A stored in the box 13B, and the device is not limited to the present embodiment.

The temperature sensor 12I measures the temperature of the intermediate transfer belt 10. The temperature sensor 12I may be placed at a position that allows the sensor to measure the temperature of the intermediate transfer belt 10, but the sensor may be placed at a position that allows the sensor to measure the temperature of the surface of the intermediate transfer belt 10 (the surface thereof to which the curable liquid 12A is supplied).

As described above, these temperature sensor 12G, driving unit 12D, and heating and cooling device 12E are connected to the temperature regulation control unit 12F so as to be able to receive or send signals, and are controlled by the temperature regulation control unit 12F.

The temperature regulation control unit 12F is connected to a control unit 11 that controls each unit and device of the recording apparatus 100 so as to be able to receive and send signals, and for example, in accordance with signals input from the control unit 11, heats or cools at a desired temperature the curable liquid 12A that is stored in the box 13B.

The curable liquid 12A in the box 13B is heated or cooled by the temperature regulation unit 12, so that the temperature of the curable liquid 12A is regulated at a desired temperature, and then the curable liquid 12A with the regulated temperature is supplied to the intermediate transfer belt 10 with the supply roller 13A of the supply unit 13. Namely, the viscosity of the curable liquid 12A is regulated with the temperature regulation unit 12 when the liquid is supplied to the intermediate transfer belt 10 with the supply roller 13A.

In the present exemplary embodiment, with the temperature regulation unit 12, the viscosity of the curable liquid 12A in the box 13B is regulated within a predetermined range, and then the liquid is supplied to the intermediate transfer belt 10 with the supply unit 13. The viscosity within a predetermined range mentioned herein means a value that can be stably measured at a shear rate of 1000 $s^{-1}$ or more.

The recording head 14 includes, from the upstream side along the traveling direction of the intermediate transfer belt 10, a recording head 14K that applies a black ink, a recording head 14C that applies a cyan ink, a recording head 14M that applies a magenta ink, and a recording head 14Y that applies a yellow ink. The configuration of the recording head 14 is not limited to the above, and for example, the head 14 may be configured only by the recording head 14K, or the recording head 14C, recording head 14M, and recording head 14Y.

Each recording head 14 is, over a non-bending area of the intermediate transfer belt 10 that is supported so as to be rotatable with a tension, placed in a manner that the distance between the surface of the intermediate transfer belt 10 and the nozzle face of the recording head 14 is adjusted at 0.7 mm to 1.5 mm.

Each recording head 14 may be, for example, a line-type ink-jet recording head having a width substantially similar to or wider than the width of the recording medium P, but conventional scan-type ink-jet recording heads may be used.

The ink applying process used in each recording head 14 is not limited as long as the process has a capability of applying an ink, and may be a piezo element driving process or a heater element driving process. The details of the ink will be described later.

The transfer unit 16 is configured as follows. Specifically, for example, the intermediate transfer belt 10 is supported with a tension by the press roll 16B and support roll 10C so as to form the non-bending area. In the non-bending area of the intermediate transfer belt 10, a support 22 that supports the recording medium P is placed at the position facing to the press roll 16B and support roll 10C. The press roll 16A is placed at the position facing to the press roll 16B through the intermediate transfer belt 10, and contacts the recording medium P through an opening (not shown in the figure) formed in the support 22.

Namely, in the transfer area from the position (hereinafter, referred to as "contact start position" in some cases) at which the intermediate transfer belt 10 and the recording medium P are nipped between the press roll 16A and the press roll 16B to the position (hereinafter, referred to as "peel position" in some cases) at which the belt 10 and the medium P are nipped between the support roll 10C and the support 22, the curable liquid layer 12B keeps in contact with both the intermediate transfer belt 10 and the recording medium P.

The stimulus application device 18 is placed inside of the intermediate transfer belt 10, and applies a stimulus, through the intermediate transfer belt 10 in the transfer area, to the curable liquid layer 12B that contacts both the intermediate transfer belt 10 and the recording medium P.

The kind of the stimulus application device 18 is selected in accordance with the kind of the curable material contained in the curable liquid 12A used herein. Specifically, for example, when a UV-light curable material that is cured by UV-light irradiation is used, as the stimulus application device 18, a UV-light irradiation device for irradiating UV-light to the curable liquid 12A (that is, the curable liquid layer 12B formed therefrom) is used. When a heat curable material that is cured by heat application is used, as the stimulus application device 18, a heat application device that applies heat to the curable liquid 12A (that is, the curable liquid layer 12B formed therefrom) is used.

Here, examples of the UV-light irradiation device may include a metal halide lamp, a high pressure mercury lamp, an ultra-high pressure mercury lamp, a deep UV-light lamp, a lamp characterized by exciting a mercury lamp using microwaves externally without electrodes, an UV-light laser, a xenon lamp, and a UV-LED.

The conditions of UV-light irradiation are not particularly limited, but may be selected in accordance with the kind of the UV-light curable material, the thickness of the curable liquid layer 12B, and the like. The conditions may include, for example, when a metal halide lamp is used, an integrated light quantity of 10 mJ/$cm^2$ to 1000 mJ/$cm^2$.

Examples of the heat application device may include a halogen lamp, a ceramic heater, a nichrome wire heater, a micro wave heating, and an infrared heater. In addition, as the heat application device, an electromagnetic induction heating device may be used.

The conditions of heat application are not particularly limited, but may be selected in accordance with the kind of the heat curable material, the thickness of the curable liquid layer 12B, and the like. The conditions may include, for example, 5 minutes at 200° C. in the air.

As the recording medium P, any of a permeable medium (for example, plain paper, coated paper or the like) and a non-permeable medium (for example, art paper, resin film or the like) may be used. The recording medium P is not limited to these, but may be an industrial product such as a semiconductor substrate.

In the recording apparatus 100 according to the present exemplary embodiment, after the intermediate transfer belt 10 is driven to rotate, at first, the curable liquid 12A is supplied onto the intermediate transfer belt 10 with the supply unit 13 so as to form the curable liquid layer 12B on the intermediate transfer belt 10.

The thickness (average thickness) of the curable liquid layer 12B is not particularly limited, but the layer may be formed to have a thickness of 0.5 μm to 100 μm from the viewpoints of satisfying both image forming properties and transferring properties at the same time, cost advantage, and allowing the curing reaction to proceed rapidly.

Further, the thickness of the curable liquid layer 12B may be selected in a manner that the ink drops 14A do not reach the lowest portion of the curable liquid layer 12B, whereby the portion of the curable liquid layer 12B where the ink drops 14A are present is not exposed after transferred to the recording medium P and the portions where the ink drops 14A are not present serves as a protection layer after curing.

Next, the ink drops 14A are applied by the recording head 14 onto the curable liquid layer 12B that has been supplied onto the intermediate transfer belt 10. The recording head 14 applies the ink drops 14A in place onto the curable liquid layer 12B in accordance with image information.

The curable liquid layer 12B may have a property of fixing an ink color material when the ink drops 14A are applied.

At this time, the ink drops 14A are applied with the recording head 14 in the non-bending area of the intermediate transfer belt 10 that is supported so as to be rotatable with a tension. That is, the ink drops 14A are applied to the curable liquid layer 12B where the belt surface is not bending.

Next, pressure is applied to the recording medium P and intermediate transfer belt 10 by nipping them between the press rolls 16A and 16B of the transfer unit 16. At this time, the curable liquid layer 12B on the intermediate transfer belt 10 contacts the recording medium P. After that, up to the position (peel position) nipped between the support roll 10C and the support 22, the curable liquid layer 12B is allowed to keep in contact with both intermediate transfer belt 10 and recording medium P.

Here, the pressure applied by the press rolls 16A and 16B to the curable liquid layer 12B is regulated in the range of 0.001 MPa to 2 MPa.

Then, with the stimulus application device 18, to the curable liquid layer 12B that is in contact with both intermediate transfer belt 10 and recording medium P, a stimulus is applied through the intermediate transfer belt 10 so as to cure the curable liquid layer 12B. Specifically, after the curable liquid layer 12B on the intermediate transfer belt 10 contacts the recording medium P (after passing through the contact start position), stimulus application is started, and before the curable liquid layer 12B is peeled off from the intermediate transfer belt 10 (before arriving at the peel position), the stimulus application is ended.

The amount of the stimulus applied may be selected in a manner that the curable liquid layer 12B is cured to an extent that the layer will be easily peeled off from the intermediate transfer belt 10. Specifically, when the stimulus is UV-light, the integrated light quantity is regulated in the range of 10 $mJ/cm^2$ to 1,000 $mJ/cm^2$.

Then, the curable liquid layer 12B is peeled off from the intermediate transfer belt 10 at the peel position, so that a cured resin layer (image layer) having an image T of the ink drops 14A is formed on the recording medium P.

The fragments of the curable liquid layer 12B and adhesion materials remained on the surface of the intermediate transfer belt 10 after the curable liquid layer 12B is transferred to the recording medium P are removed by the cleaning unit 20. After that, on the intermediate transfer belt 10, the curable liquid 12A is supplied by the supply unit 13 to form the curable liquid layer 12B again, so that an image recording process is repeated.

In this way, image recording is performed in the recording apparatus 100 according to the present exemplary embodiment.

The temperature regulation unit 12 regulates the temperature in a manner that at the time when the curable liquid 12A is supplied to the intermediate transfer belt 10, the viscosity of the curable liquid 12A is regulated in a predetermined range by heating or cooling the curable liquid 12A stored in the box 13B to have a temperature that provides a viscosity in the predetermined range.

The viscosities of the curable liquid 12A and curable liquid layer 12B shown herein may be measured with a modular viscosity and viscoelasticity measurement apparatus MARSII (manufactured by Thermo Haake Corp.) at a shear rate of 1500 $s^{-1}$.

To the temperature regulation control unit 12F, the memory 12H is connected so as to be able to send and receive signals. In the memory 12H, curable liquid information for identifying the curable liquid 12A that is an object to be stored in the box 13B, and viscosity characteristic information that indicates a relationship between the temperature and viscosity of the curable liquid 12A identified by the curable liquid information are related to each other and stored.

Figure 2:
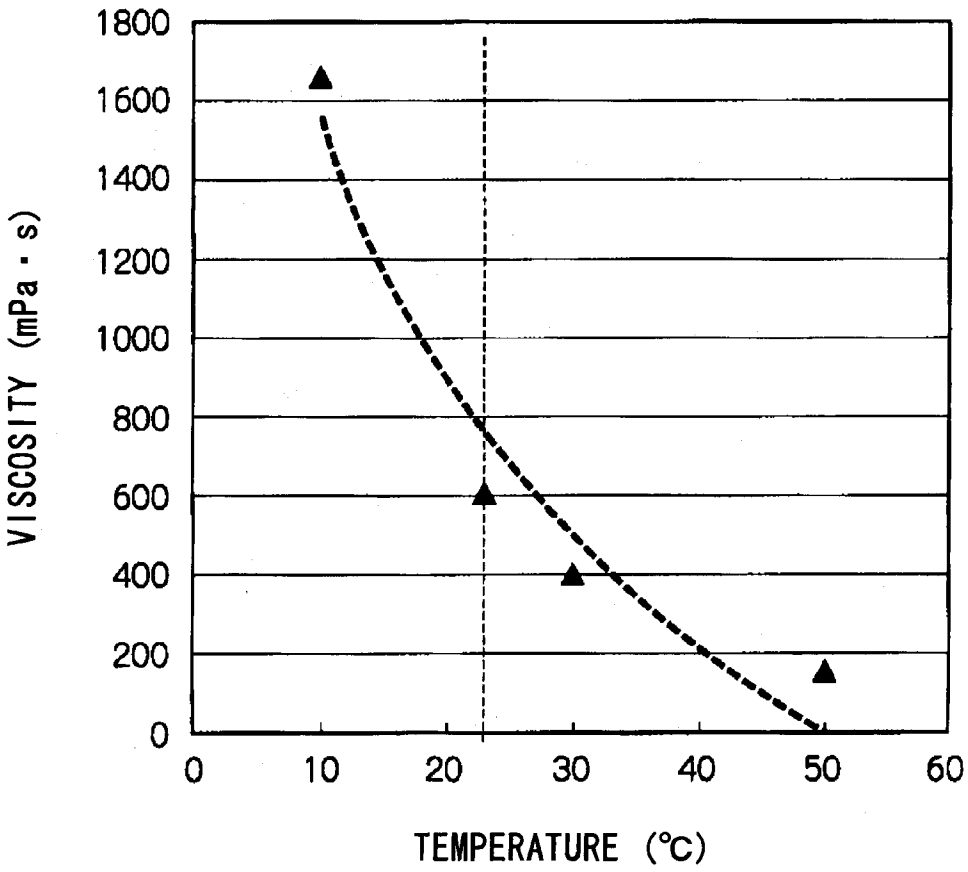
FIG. 2 is a graph showing an example of the viscosity characteristics of a curable liquid used in an exemplary embodiment of the present invention.

The viscosity characteristic information indicates the relationship between temperature (° C.) and viscosity (mPa·s) that is measured at a shear rate of, for example, 1500 $s^{-1}$ for the curable liquid 12A (curable liquid layer 12B). Specifically, the viscosity characteristic information indicates, for example, the relationship as shown in FIG. 2, indicating the relationship between the measured temperature and measured viscosity when the shear rate of 1000 $s^{-1}$ is selected as the viscosity measurement condition. In the example shown in FIG. 2, when the viscosity range of the curable liquid 12A is selected, for example, in the range of 50 mPa·s to 2000 mPa·s, the corresponding temperature condition is in the range of 10° C. to 48° C. Therefore, when the curable liquid 12A that exhibits the viscosity characteristic shown in FIG. 2 is used, the temperature regulation unit 12 regulates the viscosity in the range of 50 mPa·s to 2000 mPa·s by heating the curable liquid 12A in a manner that the temperature thereof becomes 10° C. to 48° C.

In the memory 12H, curable liquid information for identifying plural kinds of the curable liquid 12A which have viscosity characteristics different from each other and each of which is an object to be supplied, and viscosity characteristic information that indicates the viscosity characteristics corresponding to the respective curable liquids are preliminary related and stored.

The processing executed at the temperature regulation control unit 12F of the temperature regulation unit 12 is explained below.

At the control unit 11 of the recording apparatus 100, when electric power is supplied to each unit and device of the recording apparatus 100 by operating a power switch (not shown in the figure) of the recording apparatus 100, the curable liquid information for identifying the curable liquid 12A stored in the box 13B of the supply unit 13 is output to the temperature regulation control unit 12F. For example, the curable liquid information is input to the control unit 11 from an input and output terminal (not shown in the figure) of the recording apparatus 100 in accordance with operation and instruction by users or the like; and then the curable liquid information that has been input is output to the temperature regulation control unit 12F so as to be input to the temperature regulation control unit 12F.

Figure 3:
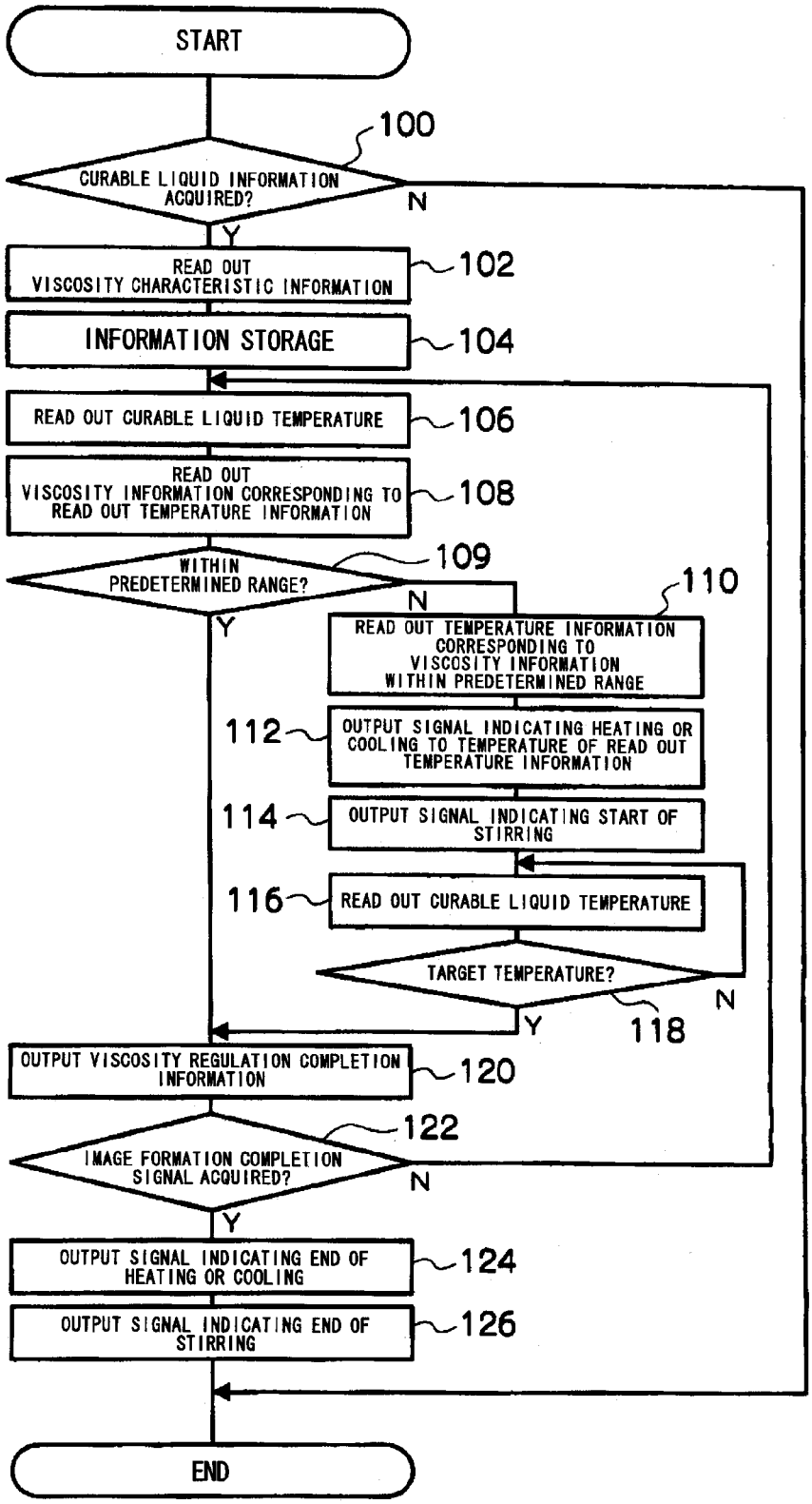
FIG. 3 is a flowchart showing processes executed at the temperature regulation control unit of a temperature regulation device.

At the temperature regulation control unit 12F, at the time when the power switch (not shown in the figure) of the recording apparatus 100 is operated and an electric power is supplied to each unit and device of the recording apparatus 100, an electric power is also supplied to the temperature regulation unit 12 to execute the processing routine shown in FIG. 3.

At step 100, a judgment whether the curable liquid information is acquired from the control unit 11 or not is made, and if denied, the processing routine is ended, and if affirmed, the processing is forwarded to step 102.

At step 102, the viscosity characteristic information corresponding to the curable liquid information acquired in the above step 100 is read out from the memory 12H, and is stored in a memory 13H at the next step 104 as the viscosity characteristic information indicating the viscosity characteristic of the curable liquid 12A stored in the box 13B.

At step 106, the temperature detection result obtained by the temperature sensor 12G that detects the temperature of the curable liquid 12A stored in the box 13B is read out.

At the next step 108, base on the viscosity characteristic information stored in the memory 13H at the above step 104, viscosity information corresponding to the temperature information of the temperature detection result read out at the above step 106 is read out. In the processing at step 108, for example, when the viscosity characteristic information is the viscosity characteristic information that indicates the viscosity characteristic shown in FIG. 2 and the information indicating 30° C. is read out as the temperature detection result at the above step 106, the information indicating 410 mPa·s that is the viscosity corresponding to 30° C. is read out as the viscosity information.

At the next step 109, whether the viscosity of the viscosity information that is read out at the above step 108 is within a predetermined range or not is judged. As the predetermined range at the step 109, the range from 50 mPa·s to 2000 mPa·s is preliminary stored in the memory 13H, and whether the viscosity is within this range or not is judged. If affirmed, the processing is forwarded to step 120, and if denied, the processing is forwarded to step 110.

When denied at the above step 109, that is, when the viscosity of the viscosity information read out at the above step 108 is out of the predetermined range, the processing is forwarded to step 110. At the step 110, temperature information corresponding to the viscosity information within the predetermined range is read out from the viscosity information that is stored in the memory 13H at the step 104.

At the step 110, for example, when the viscosity characteristic information stored in the memory 13H at the step 104 is the viscosity characteristic information indicating the viscosity characteristic shown in FIG. 2 and the viscosity information read out at the above step 108 is 20 mPa·s, a temperature having a range of 10° C. to 48° C. is read out as a temperature corresponding to the predetermined range of 50 mPa·s to 2000 mPa·s.

At the next step 112, a command signal indicating heating or cooling is output to the heating and cooling device 12E so as to regulate the temperature of the curable liquid 12A stored in the box 13B at the temperature read out at the above step 110.

The heating and cooling device 12E that receives the command signal indicating heating or cooling from the temperature regulation control unit 12F is heated or cooled at the temperature that is involved in the command signal received, so that the curable liquid 12A stored inside of the box 13B placed in contact with the heating and cooling device 12E is heated or cooled through the box 13B.

At the next step 114, a stirring start signal indicating the start of stirring of the stirring unit 12C is output to the driving unit 12D. The driving unit 12D that receives the stirring start signal drives the stirring unit 12C to rotate. By the rotation of the stirring unit 12C, the curable liquid 12A is stirred, so that the liquid absorbing material and curable material contained in the curable liquid 12A are dispersed uniformly in the curable liquid 12A.

At the next step 116, the temperature detection result obtained by the temperature sensor 12G is read out. In the next step 118, whether the temperature detection result read out in the step 116 coincides or not with the temperature of the temperature information read out in the above step 110 is judged. When denied, the processing is returned back to the step 116, and when affirmed, the processing is forwarded to step 120.

At the step 120, the viscosity regulation completion information indicating that the viscosity of the curable liquid 12A stored in the box 13B has already been regulated at a viscosity within the predetermined range is output to the control unit 11.

The control unit 11 that receives the viscosity regulation completion information starts image forming process in the recording apparatus 100, and outputs an image formation completion signal to the temperature regulation control unit 12F when the image forming process is completed.

At the next step 122, a denial judgment is repeated until the image formation completion signal indicating the completion of image formation is input from the control unit 11. When denied, the processing is returned back to the above step 106 so as to execute again the above temperature regulation, and when affirmed, the processing is forwarded to step 124.

At the step 124, a heating and cooling end signal indicating the end of heating and cooling of the curable liquid 12A stored in the box 13B is output to the heating and cooling device 12E. The heating and cooling device 12E that receives the heating and cooling end signal ends the heating and cooling of the curable liquid 12A.

At the next step 126, a stirring end signal indicating the end of stirring with the stirring unit 12C is output to the driving unit 12D, and the present routine is ended. The driving unit 12D that receives the stirring end signal ends the driving of the stirring of the stirring unit 12C.

By executing the process through the steps 100 to 126, the curable liquid 12A stored in the box 13B is heated or cooled at a temperature that gives a viscosity in the range of 50 mPa·s to 2000 mPa·s by control of the heating and cooling device 12E or the like with the temperature regulation control unit 12F. Due to this, the viscosity of the curable liquid 12A stored in the box 13B is regulated within the range of 50 mPa·s to 2000 mPa·s, and the curable liquid 12A regulated to have a viscosity within this range is supplied to the intermediate transfer belt 10.

Namely, the curable liquid 12A, which is regulated to have a viscosity within the range of 50 mPa·s to 2000 mPa·s when applied from the supply unit 13 onto the intermediate transfer belt 10, is supplied to the intermediate transfer belt 10.

As described above, according to the recording apparatus 100 of the present exemplary embodiment, the viscosity of the curable liquid 12A is regulated in the rage of 50 mPa·s to 2000 mPa·s by temperature regulation of the curable liquid 12A with the temperature regulation unit 12 when the liquid is applied on the intermediate transfer belt 10. Due to this, when applied on the intermediate transfer belt 10, a uniform thin layer is obtainable even when the layer is applied at a desired speed. On the other hand, when the curable liquid is stored, the liquid has a higher viscosity than when the liquid is applied, so that precipitation of the liquid absorbing particles may be mitigated, and uniform dispersing state may be kept.

In this way, the liquid absorbing material and curable material are uniformly dispersed in the curable liquid layer 12B formed on the intermediate transfer belt 10, and the uniform and thin curable liquid layer 12B is formed on the intermediate transfer belt 10, so that the ink drops 14A applied by the recording head 14 may be prevented from bleeding or flowing, and a high quality image may be formed.

Although it depends on the kind of the curable liquid 12A stored in the box 13B, the curable liquid 12A may be sometimes degraded by heating or cooling the curable liquid 12A at a temperature out of the range of 20° C. to 60° C. Here, the degradation of the liquid 12A indicates color change or viscosity change due to partial curing.

In order to avoid the degradation of the curable liquid 12A, the heating or cooling temperature of the curable liquid 12A in the steps 110 to 118 may be selected within the range of 20° C. to 60° C., and may be a temperature at which the viscosity is in the above predetermined range.

Note that, in the processes of steps 100 to 126, the embodiment where the stirring of the curable liquid 12A in the box 13B with the stirring unit 12C is performed only when the viscosity of the curable liquid 12A stored in the box 13B is out of the predetermined range is described, but the embodiment is not limited thereto. The stirring may be started when electric power is supplied to the recording apparatus 100. In this case, for example, after the step 100 is affirmed and the curable liquid information is acquired, stirring start signal may be output to the driving unit 12D, and then the step 102 may be executed.

In this manner, various materials such as the liquid absorbing material and the curable material that are contained in the curable liquid 12A stored in the box 13B are adequately dispersed in the curable liquid 12A, and the curing degree of the curable liquid layer 12B formed on the intermediate transfer belt 10 and the absorbing degree of the ink become uniform, whereby the quality of images may be still more improved.

Note that, the viscosity of the curable liquid layer 12B at the time when the ink drops 14A are applied from the recording head 14 may be higher than the viscosity of the curable liquid 12A having a temperature regulated with the temperature regulation unit 12 at the time when the curable liquid 12A is applied on the intermediate transfer belt 10.

In order to configure the recording apparatus 100 in a manner that the viscosity of the curable liquid layer 12B at the time when the ink drops 14A are applied from the recording head 14 is higher than the viscosity of the curable liquid 12A (curable liquid layer 12B) at the time when the curable liquid 12A is supplied to the intermediate transfer belt 10, for example, the recording apparatus may be configured as follows.

Specifically, for example, the supply unit 13 and the recording head 14 may be disposed in a manner that the supply unit 13 and recording head 14 are distanced from each other sufficiently so that the temperature of the curable liquid 12A (curable liquid layer 12B) immediately after the curable liquid 12A is applied onto the intermediate transfer belt 10 with the supply unit 13 lowers to room temperature during the curable liquid 12A is transported with the intermediate transport belt 10 to an area where the ink drops 14A are ejected from the recording head 14. Further, for example, the cooling unit 15 may be installed between the recording head 14 and the supply unit 13 so as to cool the curable liquid layer 12B formed from the curable liquid 12A that is supplied onto the intermediate transfer belt 10 from the supply unit 13. By installing the cooling unit 15, the curable liquid layer 12B formed on the intermediate transfer belt 10 with the help of the supply unit 13 is cooled and the viscosity thereof increases when the layer 12B is transported by the intermediate transfer belt 10 to the position where the cooling unit 15 is placed. In this way, the viscosity of the curable liquid layer 12B that arrives at the area where the ink drops 14A are ejected by the recording head 14 is regulated to be higher than the viscosity of the layer 12B immediately after the layer 12B is applied onto the intermediate transfer belt 10 with the supply unit 13.

In this manner, the viscosity of the curable liquid 12A at the time when the liquid 12A is supplied to the intermediate transfer belt 10 may be regulated within the predetermined range (from 50 mPa·s to 2000 mPa·s), and when the liquid 12A arrives at the area where the ink drops 14A are ejected from the recording head 14, the viscosity may be regulated to be higher than the viscosity at the time when the liquid 12A is supplied. Owing to this, the thickness of the curable liquid layer 12B at the time when the layer 12B is applied onto the intermediate transfer belt 10 may become uniform, the curable material and liquid absorbing material contained therein may be dispersed uniformly, and image degradation caused by diffusing of the ink drops out of a predetermined area may be prevented, thereby providing further improvement in image qualities.

In the present exemplary embodiment, the case where the curable liquid 12A is stored in the box 13B of the supply unit 13, and the temperature of the curable liquid 12A stored in the box 13B is regulated with the temperature regulation unit 12 is described, but in another embodiment, two or more of the box 13B may be used.

In this case, for example, a box (first box) in which the curable liquid 12A for being directly supplied to the intermediate transfer belt 10 by the supply roller 13A is stored, and another box (second box) for supplying the curable liquid 12A to the first box are separately installed. The first and second boxes are configured in a manner that the maximum capacity of the curable liquid 12A in the first box is smaller than the maximum capacity of the curable liquid 12A in the second box, and the temperature regulation unit 12 may be placed on the first box that is positioned in the vicinity of the supply roller 13A.

The configuration described above allows the viscosity of the curable liquid 12A stored in the first box having a smaller maximum storage capacity than the second box to be efficiently regulated within the above predetermined range.

Note that, in the processes of steps 100 to 126, further, in accordance with the temperature of the intermediate transfer belt 10, the temperature information that is calculated as the temperature of the curable liquid 12A supplied to the intermediate transfer belt 10 may be corrected, and the curable liquid 12A may be regulated to have the corrected temperature.

In this case, the temperature information that corresponds to the viscosity information within the predetermined range that is readout at the step 110 may be corrected in accordance with the temperature or the like of the intermediate transfer belt 10, and the temperature of the curable liquid 12A may be regulated at the corrected temperature.

Figure 6:
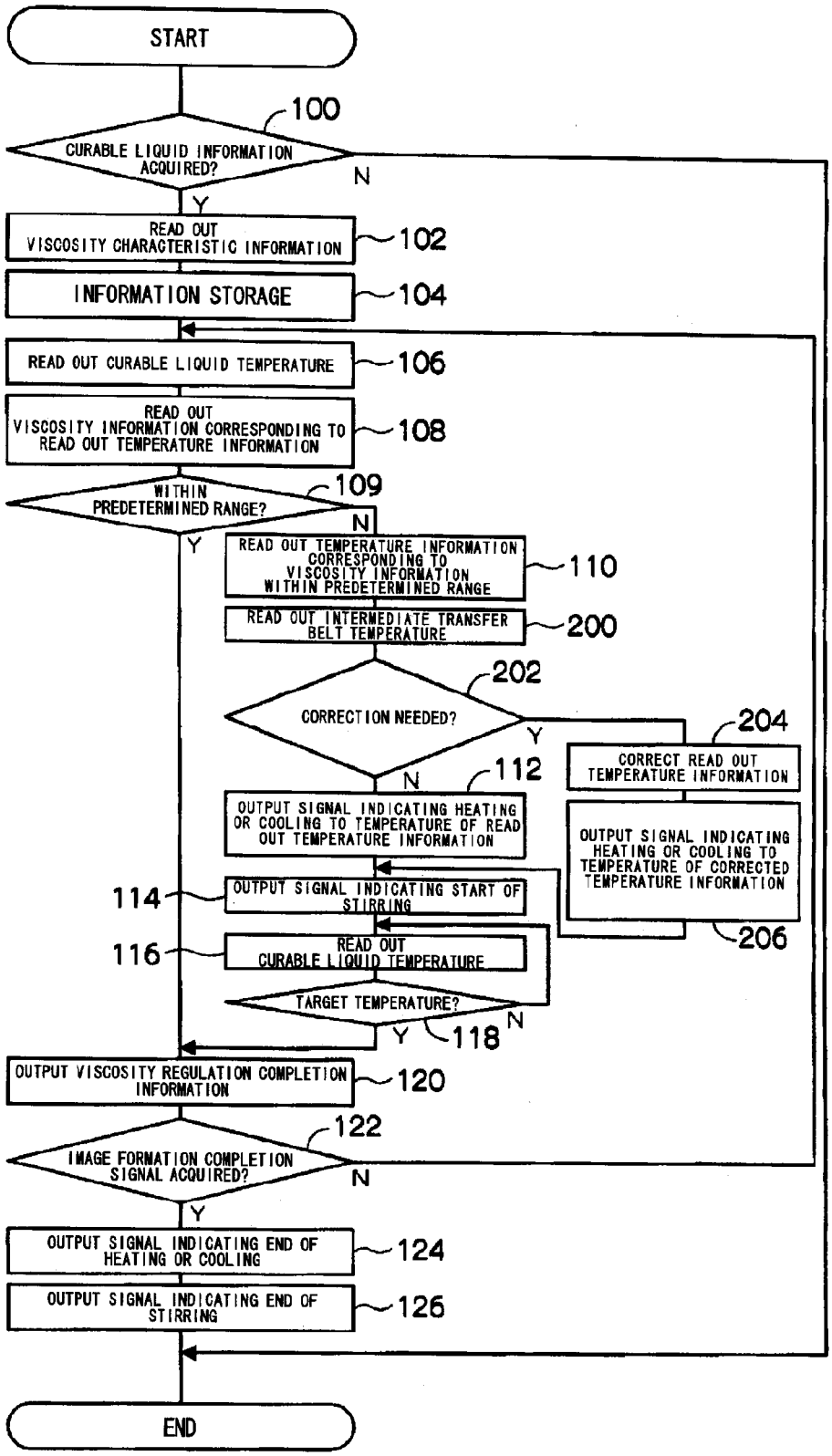
FIG. 6 is a flowchart showing processes executed at the temperature regulation control unit of a temperature regulation device.

In this case, at the temperature regulation control unit 12F of the temperature regulation unit 12, the processes shown in FIG. 6 may be executed. The same processes as in the processing routine shown in FIG. 3 are indicated by the same reference numbers, and the detailed explanations thereof are omitted.

At the temperature regulation control unit 12F, when electric power is supplied to each unit and device of the recording apparatus 100 by operating the power switch (not shown in the figure) of the recording apparatus 100, electric power is also supplied to the temperature regulation unit 12, so that the processing routine shown in FIG. 6 are executed, and the processes of steps 100 to 109 are executed.

By executing the processes of steps 100 to 109, the temperature detection result obtained by the temperature sensor 12G that detects the temperature of the curable liquid 12A stored in the box 13B is read out, and the viscosity information corresponding to the temperature information of the temperature detection result read out is read out based on the viscosity characteristic information. Then, the viscosity of the viscosity information read out is judged on whether the viscosity is in a predetermined range (in the present exemplary embodiment, in the range of 50 mPa·s to 2000 mPa·s) or not. If affirmed, after the processes of the steps 120 to 126 are executed, the present routine is ended.

On the other hand, when denied in the step 109, that is, when the viscosity of the viscosity information read out is out of the predetermined range, the processing is forwarded to the step 110, and temperature information corresponding to the viscosity information within the predetermined range is read out from the viscosity characteristic information stored in the memory 13H at the step 104. Then, the processing is forwarded to step 200.

At the next step 200, the temperature of the intermediate transfer belt 10 is read out. The process at the step 200 may be carried out by reading out the temperature detection result obtained by the temperature sensor 12I for detecting the temperature of the intermediate transfer belt 10.

At the next step 202, whether the correction of the temperature of the temperature information read out at the step 110 is needed or not is judged. The judgment at the step 202 is a process of judging on whether the viscosity of the curable liquid 12A becomes out of the predetermined range or not on the intermediate transfer belt 10 after the curable liquid 12A is regulated to have a viscosity within the predetermined range (within the range of 50 mPa·s to 2000 mPa·s in the present exemplary embodiment) by regulating the curable liquid 12A to have a temperature of the temperature information read out at the step 110 and is supplied onto the intermediate transfer belt 10. That is, when the viscosity is out of the predetermined range, the correction is judged to be needed. When the viscosity is within the predetermined range, the correction is judged not to be needed.

The judgment on whether the correction is needed or not at the step 202 may be made as follows. Whether the viscosity in the viscosity characteristic information read out at the step 102 which corresponds to the temperature of the intermediate transfer belt 10 read out at the step 200 is within the predetermined range or not is judged, for example. Then, when the viscosity is within the predetermined range, the correction may be judged not to be needed, because the possibility that the viscosity of the curable liquid 12A after it is supplied onto the intermediate transfer belt 10 becomes out of the predetermined range on the intermediate transfer belt 10 is low.

On the other hand, when the viscosity in the viscosity characteristic information which corresponds to the temperature of the intermediate transfer belt 10 read out in the step 200 is out of the predetermined range, the possibility that the viscosity of the curable liquid 12A after it is supplied onto the intermediate transfer belt 10 becomes out of the predetermined range on the intermediate transfer belt 10 is high. Therefore, in this case, the correction may be judged to be needed.

When denied in the step 202, that is, the correction of the temperature of the temperature information read out in the step 110 is not needed, the processing is forwarded to the step 112. Then, as explained with FIG. 3, the processes of steps 112 to 126 are executed, and the curable liquid 12A regulated at the temperature of the temperature information read out in the step 110 is supplied to the intermediate transfer belt 10 to form images. After that, the present routine is ended.

On the other hand, when affirmed at the step 202, that is, the correction of the temperature of the temperature information read out in the step 110 is needed, the processing is forwarded to step 204, and the temperature information read out in the step 110 is corrected.

At the step 204, the temperature information read out at the step 110 is corrected in a manner that the viscosity is kept within the predetermined range at least from the time when the curable liquid 12A regulated at a temperature of the temperature information read out at the step 110 is supplied onto the intermediated transfer belt 10 having the temperature read out at the step 200 to the time when the curable liquid 12A is transported with the intermediate transfer belt 10 and the ink drops 14A are ejected with the recording head 14 to form images.

This correction is made in accordance with the temperature of the intermediate transfer belt 10 read out at the step 200, the time during the curable liquid 12A is supplied onto the intermediate transfer belt 10 and the ink drops 14A are ejected with the recording head 14 to form images, the temperature information (temperature information related to the curable liquid 12A to be corrected) read out at the step 110, and the like.

For example, when the temperature of the intermediate transfer belt 10 read out at the step 200 is lower than the temperature range that corresponds to the viscosity within the predetermined range, in order to keep the viscosity of the curable liquid 12A supplied onto the intermediate transfer belt 10 having the above temperature within the above predetermined range, based on the temperature of the intermediate transfer belt 10 read out at the step 200, the time during the curable liquid 12A is supplied to the intermediate transfer belt 10 and the ink drops 14A are ejected with the recording head 14 to form images, and the temperature information read out at the step 110, the temperature of the temperature information read out at the step 110 is corrected to be a higher temperature.

In contrast, when the temperature of the intermediate transfer belt 10 is higher than the temperature range that corresponds to the viscosity within the predetermined range, in order to keep the viscosity of the curable liquid 12A supplied onto the intermediate transfer belt 10 having the above temperature within the predetermined range, based on the temperature of the intermediate transfer belt 10 read out at the step 200, the time during the curable liquid 12A is supplied to the intermediate transfer belt 10 and the ink drops 14A are ejected with the recording head 14 to form images, and the temperature information read out at the step 110, the temperature of the temperature information read out at the step 110 is corrected to be a lower temperature.

At the next step 206, a command signal indicating heating or cooling is output to the heating and cooling device 12E so that the temperature of the curable liquid 12A stored in the box 13B becomes the temperature of the temperature information which has been corrected in the step 204, and then the processing is forwarded to the step 114.

Then, after the processes of steps 114 to 126 are executed, the present routine is ended.

As described above, by correcting the temperature information, which is read out at the step 110 and corresponds to the viscosity information within the predetermined range, in accordance with the temperature of the intermediate transfer belt 10, and by regulating the temperature of the curable liquid 12A at the corrected temperature, the viscosity of the curable liquid 12A supplied onto the intermediate transfer belt 10 may be kept within the predetermined range and image unevenness is prevented even when the temperature of the intermediate transfer belt 10 changes.

Figure 4:
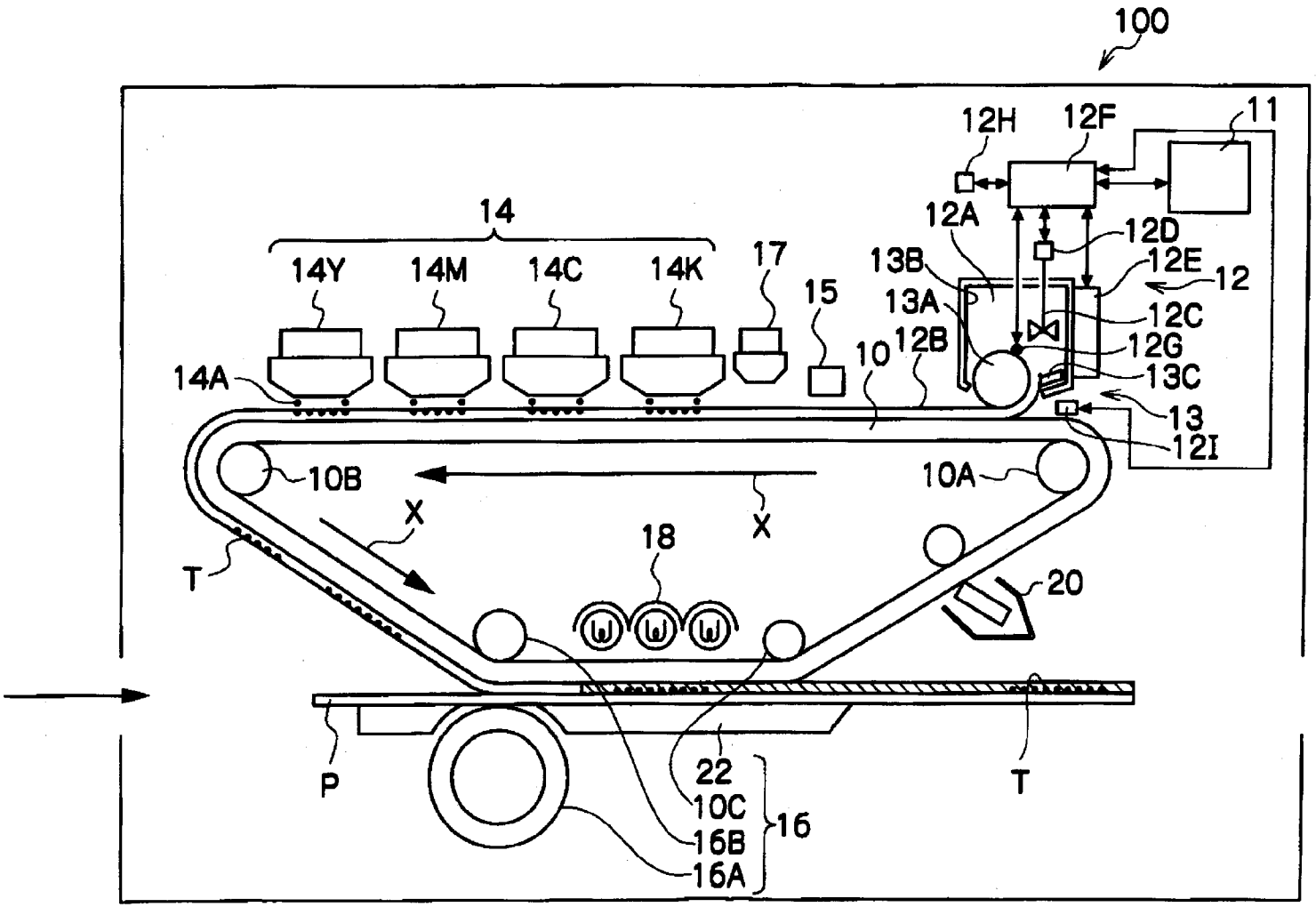
FIG. 4 is a schematic view showing another exemplary embodiment of a recoding apparatus according to the present invention, different from the one shown in FIG. 1.

Note that, the present exemplary embodiment describes one configuration in which the recording head 14 includes the recording head 14K for applying a black ink, the recording head 14C for applying a cyan ink, the recording head 14M for applying a magenta ink, and the recording head 14Y for applying a yellow ink, but as shown in FIG. 4, another configuration may be used in which a transparent liquid applying head 17 for applying a transparent liquid containing no colorant is further included.

The transparent liquid applying head 17 applies a transparent liquid having the same components as the solvent components of the ink used (for example, water) to the non-image area of the curable liquid layer 12B on the intermediate transfer belt 10. Thus, the whole of the curable liquid layer 12B including the non-image area in which no ink is applied from the respective recording heads 14K, 14C, 14M and 14Y has adhesiveness, thereby allowing complete transfer (whole surface transfer) of the curable liquid layer 12B onto the recording medium P by pressing.

Figure 5:
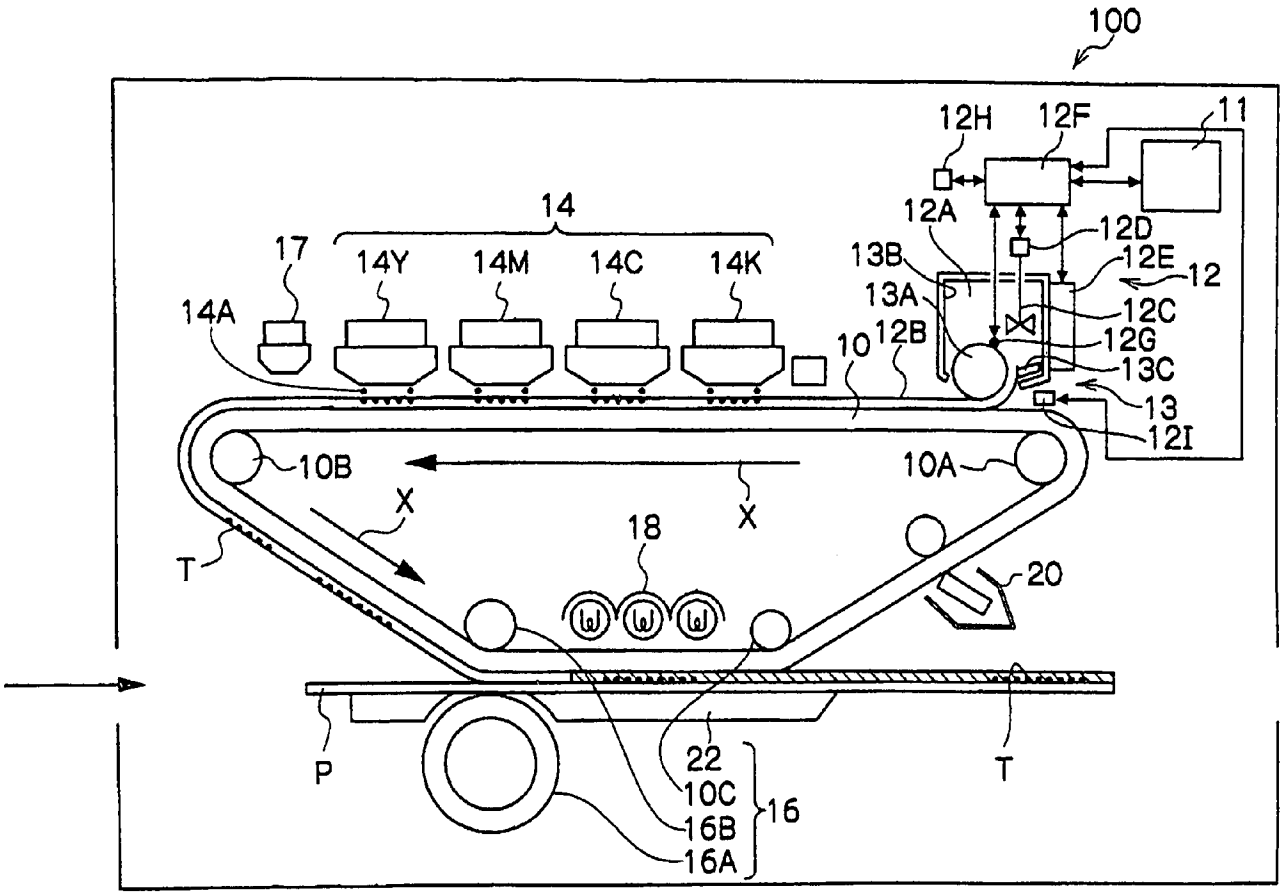
FIG. 5 is a schematic view showing still another exemplary embodiment of a recording apparatus of the present invention, different from the ones shown in FIG. 1 and FIG. 4.

The transparent liquid applying head 17 may be placed, as shown in FIG. 4, on the upstream side of the recording head 14 along the traveling direction of the intermediate transfer belt 10 and on the downstream side of the cooling unit 15 along the traveling direction, or may be placed, as shown in FIG. 5, on the downstream side of the recording head 14 along the traveling direction of the intermediate transfer belt 10 and on the upstream side of the transfer unit 16 along the traveling direction.

Hereinafter, the details of the curable liquid 12A will be described.

The curable liquid 12A contains at least a curable material that cures by an action of an external stimulus (energy) and a liquid absorbing material. The "curable material that cures by an action of an external stimulus (energy)" that is contained in the curable liquid 12A is a material that is cured into a "cured resin" by an action of an external stimulus. Specific examples thereof may include a curable monomer, a curable macromer, a curable oligomer, and a curable prepolymer.

Examples of the curable material may include a L curable material and a heat curable material. The UV curable material is easy to cure, has a higher curing speed than the other materials, and is easy to handle. The heat curable material may be cured without a large scale apparatus. The curable material is not limited to these, but a curable material that cures by an action of moisture, oxygen, or the like may be used.

Examples of the "UV cured resin" that is obtained by curing the UV curable material may include acrylic resin, methacrylic resin, urethane resin, polyester resin, maleimide resin, epoxy resin, oxetane resin, polyether resin, and polyvinylether resin. In this case, the curable liquid 12A contains at least one kind selected from a UV curable monomer, a UV curable macromer, a UV curable oligomer, and a UV curable prepolymer. Further, the curable liquid 12A may contain a UV polymerization initiator that is used to proceed UV curing reactions. Still further, the curable liquid 12A may contain optionally a reaction auxiliary agent, a polymerization promoter, or the like so as to promote the polymerization reaction still more.

Examples of the "heat cured resin" that is obtained by curing the heat curable material may include epoxy resin, polyester resin, phenol resin, melamine resin, urea resin, and alkyd resin. In this case, the curable liquid 12A contains at least one kind selected from a heat curable monomer, a heat curable macromer, a heat curable oligomer, and a heat curable prepolymer. Further, a curing agent may be added upon polymerization. Still further, the curable liquid 12A may contain a heat polymerization initiator so as to proceed heat curing reaction.

Examples of the heat polymerization initiator may include an acid such as a protonic acid or a Lewis acid, an alkali catalyst, and a metal catalyst.

As described above, any curable material may be used as long as it has a capability of being cured (for example, cured by proceeding of polymerization) by an action of an external energy such as UV light or heat.

Among the above curable materials, from the viewpoint of higher image recording speed, a material having a high curing speed (for example, a material having a high reaction speed in polymerization) may be used. Such a curable material may be, for example, a radiation curable material (such as the above UV curable material).

The viscosity of the curable liquid may be higher than the viscosity of the ink of the ink drops 14A applied onto the curable liquid when the curable liquid reaches the area where the ink drops 14A are applied with the recording head 14.

The curable liquid 12A may contain a material for fixing the colorant contained in the ink.

As the material for fixing the colorant, a material (liquid absorbing material) having a liquid absorbability with respect to the ink may be used. The liquid absorbing material is defined as a material wherein if the liquid absorbing material is mixed with the ink in a weight ratio of 30 to 100 for 24 hours and then the liquid absorbing material is taken out of the resultant mixture with a filter, the weight of the liquid absorbing material increases by 5% or more with respect to the weight thereof before it is mixed with the ink.

Examples of the liquid absorbing material may include resins (hereinafter, also referred to as liquid absorbing resins in some cases) and inorganic particles (for example, silica, alumina, zeolite, or the like) having ink-philic surface, and they are selected appropriately in accordance with the ink used herein.

Specifically, when a water-based ink is used as the ink, a water absorbing material may be used as the liquid absorbing material. Further, when an oil-based ink is used as the ink, an oil absorbing material may be used as the liquid absorbing material.

Specific examples of the water absorbing material may include: polyacrylic acid and the salt thereof; polymethacrylic acid and the salt thereof; a copolymer of (meth) acrylic acid ester, and (meth)acrylic acid and the salt thereof; a copolymer of styrene, and (meth)acrylic acid and the salt thereof; a copolymer of styrene, (meth)acrylic acid ester, and (meth)acrylic acid and the salt thereof; a copolymer of styrene, (meth)acrylic acid ester, and an ester that is formed from an alcohol having an aliphatic or aromatic substitution group having a carboxylic acid and the salt structure thereof and (meth)acrylic acid; a copolymer of (meth)acrylic acid ester and an ester that is formed from an alcohol having an aliphatic or aromatic substitution group having a carboxylic acid and the salt structure thereof and (meth)acrylic acid; a copolymer of ethylene and (meth)acrylic acid; a copolymer of butadiene, (meth)acrylic acid ester, and (meth)acrylic acid and the salt thereof; a copolymer of butadiene, (meth)acrylic acid ester, and an ester that is formed from an alcohol having an aliphatic or aromatic substitution group having carboxylic acid and the salt structure thereof and (meth)acrylic acid; polymaleic acid and the salt thereof; a copolymer of styrene, and maleic acid and the salt thereof; the foregoing resins modified with sulfonic acid; and the foregoing resins modified with phosphoric acid. More specifically, examples may include polyacrylic acid and the salt thereof; a copolymer of styrene, and (meth) acrylic acid and the salt thereof; a copolymer of styrene, (meth)acrylic acid ester, and (meth)acrylic acid and the salt thereof; a copolymer of styrene, (meth)acrylic acid ester, and an ester that is formed from an alcohol having an aliphatic or aromatic substitution group having a carboxylic acid and the salt structure thereof and (meth)acrylic acid; and a copolymer of (meth)acrylic acid ester, and (meth)acrylic acid and the salt thereof. These resins may be crosslinked or non-crosslinked.

Examples of the oil absorbing material may include: a low molecular gelling agent such as hydroxystearic acid, cholesterol derivatives, or benzylidene sorbitol; polynorbornene; polystyrene; polypropylene; a copolymer of styrene and butadiene; and various kinds of rosins. More specifically, examples may include polynorbornene, polypropylene, and rosins.

When the liquid absorbing material is in a particle shape, the volume average particle diameter thereof may be in the range of 0.05 μm to 25 μm.

The liquid absorbing material may be used in a mass ratio of 10% or more with respect to the total mass of the curable liquid 12A.

Hereinafter, additional additives that may be contained in the curable liquid 12A will be described.

The curable liquid 12A may contain a component that aggregates or thickens the ink components.

Such a component may be contained in the form of a functional group of a resin (water absorbing resin) included in the liquid absorbing resin particles, or in the form of a compound. Examples of the functional group may include carboxylic acid, polyvalent metal cations, and polyamines.

Examples of the compound may include an aggregating agent such as an inorganic electrolyte, an organic acid, an inorganic acid, or an organic amine.

The aggregating agent may be used singly or in a mixture of two or more kinds thereof. The content of the aggregating agent used herein is in the range of 0.01% by mass or more.

Hereinafter, the details of the ink used in the recording apparatus 100 will be described.

Examples of the ink may include a water-based ink that contains an aqueous solvent as a solvent, an oil-based ink that contains an oil solvent as a solvent, a UV curable ink, and a phase-change wax ink. In the present exemplary embodiment, an excellent image fixing property may be attained without vaporization of solvent by heaters or the like, even when the water-based ink or oil-based ink is used and a non-permeable medium is used as the recording medium.

Examples of the water-based ink may include an ink in which a water-soluble dye or a pigment as a recording material is dispersed or dissolved in an aqueous solvent. Examples of the oil-based ink may include an ink in which an oil-soluble dye as a recording material is dissolved in an oil solvent, and an ink in which a dye or a pigment as a recording material is dispersed in an inverted micelle state.

In the present exemplary embodiment, the water-based ink may be used as the ink. By using the water-based ink, a long-term reliability of the system including the ink-jet head may be improved compared to the case using oil-based ink or UV curable ink. In this case, the water absorbing material may be used as the liquid absorbing material contained in the curable liquid in 12A.

The recording material is described first. Examples of the recording material may include a colorant. As the colorant, any of dyes and pigments may be used, but pigments may be used because of durability. As the pigments, any of organic pigments and inorganic pigments is usable. Examples of black pigments may include carbon black pigments such as furnace black, lamp black, acetylene black, or channel black. Besides black and three primary colors including cyan, magenta and yellow, a specific color pigment such as a red, green, blue, brown, or white pigment, a metallic lustrous pigment such as a gold or silver pigment, a colorless or light-colored body pigment, a plastic pigment, and the like may be used. Further, a pigment newly synthesized for use in the present invention may be used.

Further, particles in which a dye or pigment is fixed on the surface of a core such as silica, alumina or polymer beads; insolubilized dye lake; colored emulsion; colored latex; or the like may be used as the pigment.

Examples of the black pigment may include RAVEN7000 (manufactured by Columbian Chemicals Co.), REGAL400R (manufactured by Cabot Corp.), and COLOR BLACK FW1 (manufactured by Degussa Corp.). They are not limitative, but any commercially available black pigments may be used.

Examples of the cyan pigment may include C.I. Pigment Blue-1, but are not limited to this.

Examples of the magenta pigment may include C.I. Pigment Red-5, but are not limited to this.

Examples of the yellow pigment may include C.I. Pigment Yellow-1, but are not limited to this.

When a pigment is used as the colorant, a pigment dispersant may further be used. Examples of the pigment dispersant used herein may include a polymer dispersant, an anionic surfactant, a cationic surfactant, an amphoteric surfactant, and a nonionic surfactant.

These pigment dispersants may be used singly or in combination of two or more kinds thereof. The addition amount of the pigment dispersant varies depending on the pigment, but may be in the range of 0.1% to 100% by mass as a total amount with respect to the pigment.

As the colorant, a pigment that is self-dispersible in water may be used. The pigment that is self-dispersible in water is a pigment that has a number of solubilizing groups to water on the surface thereof and is dispersible in water without the presence of a polymer dispersant. Specifically, the pigment that is self-dispersible in water may be obtained by surface modifying conventional pigments by a surface modification treatment such as acid or base treatment, coupling agent treatment, polymer grafting treatment, plasma treatment, or oxidation or reduction treatment.

In addition, examples of the pigment self-dispersible in water may include, besides the above pigments obtained by a surface modification of conventional pigments, commercially available self-dispersible pigments such as CAB-O-JET-200 manufactured by Cabot Corp.

Examples of the recording materials may include, besides the above, dyes such as hydrophilic anionic dyes, direct dyes, cationic dyes, reactive dyes, polymer dyes, or oil soluble dyes; wax or resin powders or emulsion that are colored with dyes; fluorescent dyes or pigments; IR absorbers; UV absorbers; a magnetic material such as ferromagnetic material such as ferrite or magnetite; semiconductors or photo-catalysts such as titanium oxide or zinc oxide; and other organic or inorganic electronic material particles.

The content (concentration) of the recording material may be, for example, in the range of 5% to 30% by mass with respect to the ink. The volume average particle diameter of the recording material may be, for example, in the range of 10 nm to 1,000 nm.

Next, the aqueous solvent is described. Examples of the aqueous solvent may include water. Particularly, ion-exchanged water, ultrapure water, distilled water, or ultrafiltration water may be used. In addition, along with the aqueous solvent, a water-soluble organic solvent may be used. Examples of the water-soluble organic solvent may include polyhydric alcohols, polyhydric alcohol derivatives, nitrogen-containing solvents, alcohols, and sulfur-containing solvents.

As the water-soluble organic solvent, besides the above, propylene carbonate, ethylene carbonate, or the like may be used.

The water-soluble organic solvent may be used singly or in combination of two or more kinds thereof. The content of the water-soluble organic solvent may be, for example, in the range of 1% to 70% by mass.

Next, the oil solvent is described. As the oil solvent, an organic solvent may be used such as aliphatic hydrocarbon, aromatic hydrocarbon, alcohols, ketones, esters, ethers, glycols, nitrogen-containing solvent, or plant oil. The solvent may be used singly or in combination of two or more kinds thereof.

Next, other additives are described. To the ink, besides the above, optionally a surfactant is added.

Examples of the surfactant may include various kinds of anionic surfactants, nonionic surfactants, cationic surfactants, and amphoteric surfactants. More specifically, anionic surfactants and nonionic surfactants may be used.

In addition, to the ink, besides the above, a penetrating agent for the purpose of regulating the penetrating property; polyethylene imide, polyamines, polyvinyl pyrrolidone, polyethylene glycol, ethyl cellulose, or carboxymethylcellulose for the purpose of improving the ejection property of the ink; alkali metal compounds such as potassium hydroxide, sodium hydroxide, or lithium hydroxide for the purpose of regulating the conductivity or pH; further, optionally a pH buffering agent, an anti-oxidation agent, an anti-mold agent, a viscosity improver, a conductive agent, a UV absorber, a chelating agent, and the like may be also added.

Next, properties of the ink are described. The surface tension of the ink (measured with a Wilhelmy surface tensiometer (manufactured by KYOWA INTERFACE SCIENCE CO., LTD.) in an environment of 23° C. and 55% RH) may be regulated within the range of 20 to 45 mN/m.

The ink may have a viscosity (measured with a modular viscosity and viscoelasticity measurement apparatus MARSII (manufactured by Thermo Haake Corp.) at a shear rate of 1000 $s^{-1}$ and a measurement temperature of 23° C.) of 1.5 to 30 mPa·s.

Note that, the ink is not limited to the composition described above. Besides the recording material, the ink may include, for example, a functional material such as a liquid crystal material or an electronic material.

EXAMPLES

Hereinafter, the present invention will be described in detail based on examples, however, the present invention is in no way limited by the following examples.

Example 1

Using a recording apparatus (see FIG. 1) having a configuration similar to the above exemplary embodiment, a curable liquid having a temperature regulated with a temperature regulation device is supplied with a supply device to an intermediate transfer belt to form a curable liquid layer, and then each color ink is applied with a recording head to the curable liquid layer so as to form an image on the layer to be cured. After that, while the curable liquid layer is brought into contact with a recording medium with a transfer device, a stimulus is supplied with a stimulus application device so as to cure the curable liquid layer, which is then peeled off from the intermediate transfer belt to form an image on the recording medium. The conditions of the recording apparatus and others used in Example 1 are as follows. The following UV irradiation intensity and integrated light quantity are the UV irradiation intensity and integrated light quantity that are measured after the light transmits through the intermediate transfer belt.

Intermediate transfer belt: an end-less belt made of ETFE having a thickness of 0.1 mm, a belt width of 350 mm, and an outside diameter of 168 mm, coated with a fluoro resin (process speed: 125 mm/s);

Supply device: a reverse coater;

Temperature regulation device: a temperature regulation unit 12 having a configuration shown in FIG. 1 is used to execute a processing routine shown in FIG. 3, and a program indicating the processing routine is preliminary stored in a memory;

Each recording head: piezo recording head (having a resolution of 1200×1200 dpi (dpi: number of dots per inch, hereinafter in the same manner) and a drop size of 2 pL);

Transfer device (press roll): a steel pipe having a diameter of 30 mm, coated with a fluoro resin (pushing force against the intermediate transfer belt in terms of linear pressure: 2 kgf/cm);

Stimulus application device: a metal halide lamp (irradiating light at a UV irradiation intensity of 240 W/cm and an integrated light quantity of 100 mJ/$cm^2$); and Recording medium: art paper (OK KINFUJI, manufactured by Oji paper Co., Ltd.).

The curable liquid and each color ink used herein are prepared as follows.

—Curable Liquid—

(Curable Material)

Urethane acrylate (tri-functional): 60 parts by mass;

Acroyl morphiline acrylate: 40 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

The above components are mixed and stirred with a ball mill for 50 hours to prepare a curable liquid.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2120 mPa·s. Under the same conditions but at a measurement temperature of 32° C., the result is 1520 mPa·s.

—Black Ink—

To 30 parts by mass of carbon black, 3 parts by mass of a pigment dispersant are added, and further ion-exchanged water is added to obtain 300 parts by mass of a liquid. The liquid is dispersed with an ultrasonic homogenizer. The liquid is subjected to centrifugal separation (at 8000 rpm for 30 minutes) with a centrifugal separator, and 100 parts by mass of residue is removed from the liquid. The liquid is passed through a 1 μm filter to obtain a pigment dispersion liquid.

Then, the following components are sufficiently mixed, and the resultant mixture is subjected to pressure filtration with a 1 μm filter to obtain a black ink. The viscosity of the ink is 3.1 mPa·s and the surface tension is 32 mN/m.

Above pigment dispersion liquid: 40 parts by mass;

Glycerin: 20 parts by mass;

Acetylene glycol ethylene oxide adduct: 1.5 parts by mass; and

Pure water: 35 parts by mass.

—Cyan Ink—

C.I. Pigment Blue 15:3: 4 parts by mass;

Pigment dispersant: 1.5 parts by mass;

Diethylene glycol: 12 parts by mass;

Glycerin: 13 parts by mass;

Butylcarbitol: 5 parts by mass; and 1,3-Butane diol: 2 parts by mass.

The above components are mixed, and conditioned by further addition of pure water and NaOH, and then the resultant liquid is filtered with a 2 μm filter to obtain a cyan ink. The viscosity of the ink is 3.9 mPa·s, and the surface tension is 28 mN/m.

—Magenta Ink—

C.I. Pigment Red 122: 5 parts by mass;

Pigment dispersant: 3.5 parts by mass;

Propylene glycol: 10 parts by mass;

Glycerin: 15 parts by mass;

Dipropylene glycol: 4 parts by mass; and

Tetramethyldecinediol oxyethylene adduct: 1.5 parts by mass.

The above components are mixed, and conditioned by further addition of pure water and NaOH, and then the resultant liquid is filtered with a 2 μm filter to obtain a magenta ink. The viscosity of the ink is 4.1 mPa·s, and the surface tension is 32 mN/m.

—Yellow Ink—

C.I. Pigment Yellow 74: 5 parts by mass;

Pigment dispersant: 3 parts by mass;

Diethylene glycol: 18 parts by mass;

Triethylene glycol: 10 parts by mass;

1,2-Hexane diol: 3 parts by mass; and

Oxyethylene laurylether: 0.5 part by mass.

The above components are mixed, and conditioned by further addition of pure water and NaOH, and then the resultant liquid is filtered with a 2 μm filter to obtain a yellow ink. The viscosity of the ink is 4.1 mPa·s, and the surface tension is 35 mN/m.

The viscosities of the black, cyan, magenta, and yellow inks are measured with the modular viscosity and viscoelasticity measurement apparatus MARSII (manufactured by Thermo Haake Corp.) at a shear rate of 1000 $s^{-1}$ and a measurement temperature of 22° C.

<Evaluation>

The curable liquid prepared in Example 1 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2120 mPa·s are related to each other and stored, and temperature information of 32° C. and the corresponding viscosity information indicating a viscosity of 1520 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 50° C. that corresponds to the viscosity information indicating 1520 mPa·s is read out.

With the recording apparatus having the above conditions, the layer thickness uniformity of the curable liquid layer formed on the intermediate transfer belt is evaluated.

(Layer Thickness Uniformity)

—Layer Thickness Uniformity Evaluation—

A layer to be cured is formed by supplying the curable liquid with a liquid supply device to the intermediate transfer belt, and each ink is ejected with a recording head onto the layer to be cured to form an image. After the layer to be cured is transferred to a recording medium with a transfer device, a stimulus is applied with a stimulus application device, so that the layer to be cured is cured and an image is formed.

An image with an image coverage of 50%, 150 mm×150 mm in size, is printed on the layer to be cured that is formed on the intermediate transfer belt, and then the apparatus is stopped. The image is subjected to visual observation.

Evaluation is performed using the following evaluation criteria. The evaluation is performed ten times and then judged. The evaluation result is shown in Table 1.

—Evaluation Criteria—

Evaluation is performed with the following evaluation criteria.

G1: (No streaks or unevenness are found by visual observation),

G2: (No streaks are found by visual observation. Slight unevenness is observed), and G3: (Streaks or unevenness are clearly found by visual observation).

Example 2

In Example 2, in place of the curable liquid used in Example 1, the following curable liquid is used.

Urethane acrylate (hexa-functional): 40 parts by mass;

Polyester acrylate (tetra-functional): 30 parts by mass;

Acroyl morphiline acrylate: 30 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

The above components are mixed and stirred with a ball mill for 50 hours to prepare a curable liquid.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 3500 mPa·s. Under the same conditions but at a measurement temperature of 55° C., the result is 1750 mPa·s.

Note that, except the above curable liquid, the same materials including the inks as those used in Example 1 are used herein.

<Evaluation>

The curable liquid prepared in Example 2 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 3500 mPa·s are related to each other and stored, and temperature information of 55° C. and the corresponding viscosity information indicating a viscosity of 1750 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 55° C. that corresponds to the viscosity information indicating 1430 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

Example 3

In Example 3, in place of the curable liquid used in Example 1, the following curable liquid is used.

Urethane acrylate (tri-functional): 15 parts by mass;

Polyester acrylate (bi-functional): 35 parts by mass;

Acroyl morphiline acrylate: 50 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

The above components are mixed and stirred with a ball mill for 50 hours to prepare a curable liquid.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2100 mPa·s. Under the same conditions but at a measurement temperature of 55° C., the result is 50 mPa·s.

Note that, except the above curable liquid, the same materials including the inks as those used in Example 1 are used herein.

<Evaluation>

The curable liquid prepared in Example 3 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2100 mPa·s are related to each other and stored, and temperature information of 55° C. and the corresponding viscosity information indicating a viscosity of 50 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 55° C. that corresponds to the viscosity information indicating 50 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

Example 4

In Example 4, in place of the curable liquid used in Example 1, the following curable liquid is used.

Urethane acrylate (tetra-functional): 50 parts by mass;

Polyester acrylate (bi-functional): 30 parts by mass;

Acroyl morphiline acrylate: 20 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

The above components are mixed and stirred with a ball mill for 50 hours to prepare a curable liquid.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 3500 mPa·s. Under the same conditions but at a measurement temperature of 48° C., the result is 2000 mPa·s.

Note that, except the above curable liquid, the same materials including the inks as those used in Example 1 are used herein.

<Evaluation>

The curable liquid prepared in Example 4 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 3500 mPa·s are related to each other and stored, and temperature information of 48° C. and the corresponding viscosity information indicating a viscosity of 2000 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 48° C. that corresponds to the viscosity information indicating 2000 mPa·s is read out.

With the recording apparatus having the above conditions, the layer thickness uniformity of the curable liquid layer formed on the intermediate transfer belt is evaluated in the same manner as in Example 1. The evaluation result is shown in Table 1

Example 5

In Example 5, in place of the curable liquid used in Example 1, the following curable liquid is used.

Urethane acrylate (tetra-functional): 40 parts by mass;

Polyester acrylate (tetra-functional): 10 parts by mass;

Acroyl morphiline acrylate: 50 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

The above components are mixed and stirred with a ball mill for 50 hours to prepare a curable liquid.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2600 mPa·s. Under the same conditions but at a measurement temperature of 45° C., the result is 500 mPa·s.

Note that, except the above curable liquid, the same materials including the inks as those used in Example 1 are used herein.

<Evaluation>

The curable liquid prepared in Example 5 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2600 mPa·s are related to each other and stored, and temperature information of 45° C. and the corresponding viscosity information indicating a viscosity of 500 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 45° C. that corresponds to the viscosity information indicating 500 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

Example 6

In Example 6, the curable liquid of Example 1 is used. Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2120 mPa·s. Under the same conditions but at a measurement temperature of 44° C., the result is 1000 mPa·s.

Note that, except the above curable liquid, the same materials including the inks as those used in Example 1 are used herein.

<Evaluation>

The curable liquid prepared in Example 6 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2120 mPa·s are related to each other and stored, and temperature information of 44° C. and the corresponding viscosity information indicating a viscosity of 1000 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 44° C. that corresponds to the viscosity information indicating 1000 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

Example 7

In Example 7, the same materials including the curable liquid and the inks as those used in Example 1 are used.

<Evaluation>

Under the same evaluation conditions as those in Example 1, the layer thickness uniformity of the curable liquid layer formed on the intermediate transfer belt is evaluated in the same manner as in Example 1, except that the start of stirring signal output process indicating the start of stirring of the stirring unit 12C in the step 114 of FIG. 3 is not executed and that the rotation of the stirring unit 12C is not performed. The evaluation result is shown in Table 1.

Image quality evaluation is performed on Example 1 and Example 7 under the following image quality evaluation conditions. The evaluation results are shown in Table 2.

—Image Quality Evaluation—

A curable liquid is supplied from the liquid supply device to the intermediate transfer belt so as to form a layer to be cured, and then each ink is ejected from the recording head onto the layer to be cured to form an image. After the layer to be cured is transferred with the transfer device to a recording medium, a stimulus is supplied from the stimulus application device, so that the layer to be cured is cured and an image is formed.

Letters from 2 points to 10 points in size are printed on the layer to be cured that is formed on the intermediate transfer belt, and then the layer to be cured is transferred with the transfer device to the recording medium. A test of continuously printing the letters on 100 sheets of the recording medium is performed. The printed image on the 100th sheet is subjected to evaluation.

—Evaluation Criteria—

Evaluation is performed using the following evaluation criteria.

G1: The line images are locally broadened, but the letters are clear.

G2: The line images are locally broadened, and some of the letters are not clear.

Example 8

In Example 8, the same materials including the curable liquid and the inks as those used in Example 1 are used.

<Evaluation>

Under the same evaluation conditions as those in Example 1, the layer thickness uniformity of the curable liquid layer formed on the intermediate transfer belt is evaluated in the same manner as in Example 1, except that the processing routine shown in FIG. 6 is executed in place of the processing routine shown in FIG. 3. The evaluation result is shown in Table 1.

Comparative Example 1

In Comparative Example 1, in place of the curable liquid used in Example 1, the following curable liquid is used.

—Curable Liquid—

(Curable Material)

Silicone modified acryl HC1101 (trade name, manufactured by GE Toshiba silicones Corp.): 20 parts by mass;

Acroyl morphiline acrylate: 80 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2120 mPa·s. Under the same conditions but at a measurement temperature of 65° C., the result is 40 mPa·s.

Note that, except the above curable liquid, the same materials including the inks as those used in Example 1 are used herein.

<Evaluation>

The curable liquid prepared in Comparative Example 1 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2120 mPa·s are related to each other and stored, and temperature information of 65° C. and the corresponding viscosity information indicating a viscosity of 40 mPa·s are related to each other and stored.

Then, the recording apparatus 100 is installed in an environment of 22° C. At this time, the temperature of the curable liquid 12A in the box 13B that is read out by the temperature sensor 12G is 22° C. Therefore, the temperature of the curable liquid 12A in the box 13B that is read out by the temperature sensor 12G in the step 106 of FIG. 3 is the temperature information indicating 22° C. Further, as the temperature information that corresponds to the viscosity information within the predetermined range in the step 110 of FIG. 3, the temperature information indicating 65° C. that corresponds to the viscosity information indicating 40 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

Comparative Example 2

In Comparative Example 2, in place of the curable liquid used in Example 1, the following curable liquid is used.

—Curable Liquid—

(Curable Material)

Silicone modified acryl HC1101 (trade name, manufactured by GE Toshiba silicones Corp.): 70 parts by mass;

Acroyl morphiline acrylate: 30 parts by mass;

(Liquid Absorbing Material)

Crosslinked sodium polyacrylate (having a volume average particle diameter of 3.0 μm): 35 parts by mass;

(Additives)

Surfactant: 2.0 parts by mass; and (Photopolymerization Initiator)

2-Hydroxy-2-methyl-1-phenyl-propan-1-one: 2 parts by mass.

Thus prepared curable liquid is subjected to the measurement with the modular viscosity and viscoelasticity measurement apparatus MARSII (manufactured by Thermo Haake Corp.) at a shear rate of 1500 $s^{-1}$ and a measurement temperature of 22° C. The result is 2120 mPa·s. Under the same conditions but at a measurement temperature of 40° C., the result is 1512 mPa·s.

Note that, except the above curable liquid, the same materials including the inks as those used in Example 1 are used herein.

<Evaluation>

The curable liquid prepared in Comparative Example 2 is filled in the box 13B of the supply unit 13 in the recording apparatus 100 having the configuration shown in FIG. 1. In the memory 12H of the temperature regulation unit 12, as the viscosity characteristic information corresponding to the information indicating the curable liquid 12A, temperature information of 22° C. and the corresponding viscosity information indicating a viscosity of 2120 mPa·s are related to each other and stored, and temperature information of 40° C. and the corresponding viscosity information indicating a viscosity of 1512 mPa·s are related to each other and stored.

Then, the recording apparatus 100 is installed in an environment of 40° C. At this time, the temperature of the curable liquid 12A in the box 13B that is read out by the temperature sensor 12G is 40° C. Therefore, the temperature of the curable liquid 12A in the box 13B that is read out by the temperature sensor 12G in the step 106 of FIG. 3 is the temperature information indicating 40° C. Further, as the temperature information that corresponds to the viscosity information within the predetermined range in the step 110 of FIG. 3, the temperature information indicating 40° C. that corresponds to the viscosity information indicating 1512 mPa·s is read out.

With the recording apparatus having the above conditions, the layer thickness uniformity of the curable liquid layer formed on the intermediate transfer belt is evaluated in the same manner as in Example 1. The evaluation result is shown in Table 1.

TABLE 1

| | | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|---|
| Viscosity of curable liquid when supplied to intermediate transfer belt (mPa · s) | | 1520 | 1430 | 50 | 2000 | 500 | 1000 | 1520 | 1520 | 40 | 2120 |
| Evaluation | Layer thickness uniformity | G1 | G1 | G1 | G2 | G1 | G1 | G1 | G1 | G3 | G3 |

TABLE 2

| | | Example 1 | Example 7 |
|---|---|---|---|
| | With or without stirring | With stirring | Without stirring |
| Evaluation | Image quality evaluation | G1 | G2 |

What is claimed is:

1. A recording apparatus comprising:

an intermediate transfer member;

a supply unit that includes a liquid storage unit that stores a curable liquid, and supplies the curable liquid stored in the liquid storage unit onto the intermediate transfer member, the curable liquid including at least one curable material that is cured by an external stimulus, and a liquid absorbing material;

a first temperature information acquisition unit that acquires temperature information related to the curable liquid;

a temperature regulation unit that regulates the temperature of the curable liquid supplied onto the intermediate transfer member;

an ink application unit that applies an ink onto a curable liquid layer formed on the intermediate transfer member;

a transfer unit that brings the curable liquid layer onto which the ink has been applied into contact with a recording medium, and transfers the curable liquid layer from the intermediate transfer member to the recording medium; and a stimulus application unit that applies a stimulus for curing the curable liquid layer to the curable liquid layer, wherein the temperature regulation unit includes:

a heating and cooling unit that heats and cools the curable liquid stored in the liquid storage unit;

an information storage unit that stores viscosity characteristic information that indicates a relationship between the temperature and the viscosity of the curable liquid;

a second temperature information acquisition unit that acquires temperature information related to the intermediate transfer member; and a control unit that controls the heating and cooling unit based on at least the temperature information acquired by the first temperature information acquisition unit, the temperature information acquired by the second temperature information acquisition unit, and the viscosity characteristic information.

2. The recording apparatus according to claim 1, wherein the curable liquid layer has an average thickness of from about 0.5 μm to about 100 μm.

3. The recording apparatus according to claim 1, wherein the curable material is selected from the group consisting of a UV curable material, an electron beam curable material, and a heat curable material.

4. The recording apparatus according to claim 1, wherein the supply unit includes a stirring unit that stirs the curable liquid stored in the liquid storage unit.

5. The recording apparatus according to claim 1, wherein the viscosity of the curable liquid layer at the time of application of the ink thereonto by the ink application unit is larger than that of the curable liquid at the time of supply thereof onto the intermediate transfer member by the supply unit.

6. A recording method comprising:

storing a curable liquid including at least one curable material that is cured by an external stimulus and a liquid absorbing material;

supplying the stored curable liquid onto an intermediate transfer member;

acquiring temperature information related to the stored curable liquid;

acquiring temperature information related to the intermediate transfer member;

heating and cooling the stored curable liquid;

controlling the heating and cooling based on at least the acquired temperature information related to the curable liquid, the acquired temperature information related to the intermediate transfer member, and viscosity characteristic information that indicates a relationship between the temperature and the viscosity of the curable liquid, thereby regulating the temperature of the curable liquid supplied onto the intermediate transfer member;

applying an ink onto a curable liquid layer formed on the intermediate transfer member;

bringing the curable liquid layer onto which the ink has been applied into contact with a recording medium, and transferring the curable liquid layer from the intermediate transfer member to the recording medium; and applying a stimulus for curing the curable liquid layer to the curable liquid layer.

7. The recording method according to claim 6, wherein the curable liquid layer has an average thickness of from about 0.5 μm to about 100 μm.

8. The recording method according to claim 6, wherein the curable material is selected from the group consisting of a UV curable material, an electron beam curable material, and a heat curable material.

9. The recording method according to claim 6, further comprising stirring the stored curable liquid.

10. The recording method according to claim 6, wherein the viscosity of the curable liquid layer at the time of the applying of the ink thereonto is larger than that of the curable liquid at the time of the supplying thereof onto the intermediate transfer member.

11. The recording apparatus according to claim 1, wherein the supply unit supplies the curable liquid stored in the liquid storage unit onto the intermediate transfer member by roll coating, and the viscosity of the curable liquid supplied onto the intermediate transfer member is from 1000 mPa·s to about 2000 mPa·s.

12. The recording method according to claim 6, wherein the stored curable liquid is supplied onto the intermediate transfer member by roll coating, and the viscosity of the curable liquid supplied onto the intermediate transfer member is from 1000 mPa·s to about 2000 mPa·s.

13. The recording apparatus according to claim 1, further comprising a cooling unit that is disposed between the supply unit and the ink application unit, and cools the curable liquid layer formed on the intermediate transfer member.

* * * * *